US006179204B1

(12) United States Patent
Blower et al.

(10) Patent No.: US 6,179,204 B1
(45) Date of Patent: Jan. 30, 2001

(54) DIE CUT LOCK TRAY

(75) Inventors: James F. Blower, San Clemente; Frank D. Andruss, Huntington Beach; Todd A. Hansen, Laguna Hills; Galdino V. Ramirez, Santa Ana; Raul Escutia, Anaheim, all of CA (US)

(73) Assignee: Blower-Dempsey Corporation, Santa Ana, CA (US)

( * ) Notice: Under 35 U.S.C. 154(b), the term of this patent shall be extended for 0 days.

(21) Appl. No.: 09/420,050

(22) Filed: Oct. 18, 1999

(51) Int. Cl.[7] ..... B65D 5/22

(52) U.S. Cl. ..... 229/178; 493/70; 493/80; 493/162

(58) Field of Search ..... 229/125.19, 178; 493/70, 80, 160, 161, 162

(56) References Cited

U.S. PATENT DOCUMENTS

| | | | | |
|---|---|---|---|---|
| 1,997,523 | * | 4/1935 | Katz | 229/178 |
| 2,942,768 | * | 6/1960 | McCall | 229/178 |
| 3,139,228 | * | 6/1964 | Wilkins | 229/178 |
| 3,904,106 | * | 9/1975 | Elder | 229/178 |
| 4,279,374 | * | 7/1981 | Webinger | 229/178 |
| 5,211,329 | * | 5/1993 | Patton | 229/178 |
| 5,328,090 | * | 7/1994 | Hanlon | 493/162 |
| 5,718,337 | * | 2/1998 | Carr et al. | 229/178 |

FOREIGN PATENT DOCUMENTS

| | | | | |
|---|---|---|---|---|
| 458312 | * | 4/1951 | (IT) | 229/178 |

* cited by examiner

*Primary Examiner*—Gary E. Elkins
(74) *Attorney, Agent, or Firm*—Knobbe, Martens, Olson & Bear, LLP

(57) ABSTRACT

A tray is assembled by automated equipment from a die cut blank. Tabs on opposing ends of side pieces are enfolded in rolled ends. A serrated edge on a distal edge of each rolled end is placed into a slit and crushed area to interlock the distal edge with the blank and form a tray with interlocked walls. The serrated edge does not penetrate the die cut blank, thus providing a leakproof, interlocked tray. Perforations define various fold lines to facilitate the use of automated equipment to form the tray. Release paper is placed on the central portion of the tray, with cake batter placed on the release paper. The batter can be baked into a cake while still in the tray.

32 Claims, 6 Drawing Sheets

DIE CUT LOCK TRAY

FIELD OF THE INVENTION

The present invention relates to a die cut lock tray, its method of manufacture, and its use in an automated food production line.

BACKGROUND OF THE INVENTION

Die cut trays are erected from cardboard or other corrugated sheet material and folded into the desired shape. They are often held in position by appropriately folding and interlocking various parts of the tray. Friction can be used to interlock the parts, but such friction-based locks can fail when the cardboard changes shape through use, wear or from environmental changes. Thus, interlocking parts typically require cutting holes or slots through the tray and inserting parts through the holes and completely through the parts in order to mechanically lock the parts together. But this mechanical interlocking that uses slots weakens the trays in the area where the slots are placed.

The slotted interlocks cause further problems when they are used in some applications. The low cost of these trays makes them suitable for use in mass produced products where the trays assembly can be automated and the trays used on assembly lines. For example, these trays provide an economical way to process and distribute food products, such as cakes and muffins.

A machine forms a die cut tray from a palette of die cut blanks and drops the formed tray onto a conveyor belt. A wax-paper liner is placed on the tray to prevent the food from being absorbed by and sticking to the paper. Batter is poured into the tray for baking, and the batter-filled tray passes through an oven where the cake is baked in the tray. If the shape of the tray changes, the shape of the cake is altered and may render the cake unsuitable for sale. Thus, it is important that the tray holds its shape during the filling and baking process. Further, because thousands of cakes are baked on these automated lines, even a small percentage of trays losing shape or leaking can cause a large loss of money as the baked cakes are much more expensive than the trays. Thus, the tray assembly and the ability to maintain the tray shape must be not only inexpensive, but very reliable.

While the slotted interlocking trays hold their shape, the interlocking slots are typically located on or near the bottom of the tray. The slots thus allow the batter to leak and contaminate the assembly line. Given that tens of thousands of cakes can be baked daily, even a small leakage from a small percentage of trays quickly causes numerous problems, ranging from health and contamination concerns, to equipment maintenance and breakage problems. There is thus a need for low-cost trays that can be inexpensively made, assembled by automated equipment, yet maintain their shape during use and not leak. These objectives must be achieved with a very high repeatability and reliability.

SUMMARY OF THE INVENTION

These objectives are achieved by providing a serrated edge on an end roll that engages a lip formed along a slit edge surrounding a crushed area into which the serrated edge is inserted. The lip engages the end roll and serrated edge to form a mechanical lock that maintains the shape of the tray. The slit does not go through the material, so there is no leakage, and a stronger tray is formed. The crushed area allows the serrated edge to enter a portion of the material sufficient to interlock with the lip formed by the slit, in order to form a strong interlock. The serrated edge allows a variable interconnection with the lip sufficient to increase the formation of a successful interlock to an acceptable level of reliability and repeatability.

The tray is made from a die cut blank of corrugated paper that is formed into a tray by an automated process. The tray has a bottom wall, two opposing end rolls each connected to an opposing side of the bottom wall by an end-fold line. At least one slit and crushed area is placed in the bottom wall adjacent to each of the fold lines. The crushed area is bounded by the slit, and the area is crushed sufficiently so a slight lip is formed along the slit. A serration is formed along a length of the distal edges of the end rolls, parallel to the fold line. When assembled, the serrated edge enters the crushed area and the lip formed along the slit restrains the serrated edge from leaving the crushed area in order to form a mechanical lock that holds the tray together.

The tray also has a pair of side walls, one connected to each side of the bottom wall along a side wall fold line that is substantially perpendicular to the fold lines connecting the end rolls to the bottom wall. At each of the four corners of the bottom is a tab that is connected to an end of the side wall by a tab fold line. The tab fold line is substantially perpendicular to the side wall fold line connection between said side wall and said bottom wall.

The tabs, sides and ends are folded perpendicular to the bottom, with the tabs being further folded along the ends, parallel to the end fold line on an interior side of the end rolls. Suitable tapers are formed on the tabs to allow this folding. The distal end of each end roll is then further folded over the tabs so the serrated edge enters the crushed area and the lip along the slit engages the end roll along the serrated edge to lock the ends in position. A pair of edge defining fold lines can be added to the end roll to define the top edge of the folded tray formed by the end roll and to assist in folding the end roll. The edge defining fold lines are located slightly more toward the end fold line than they are toward the serrated edge.

This assembly can be done using automated equipment that forms the assembled tray from a die cut sheet of material. The assembled tray is then placed on an assembly line. A liner or release material is placed on the bottom of the tray. Batter is placed on the bottom of the tray. The cake is baked, cooled and packaged in the tray.

DETAILED DESCRIPTION

Die Cut Blank

Figure 1:
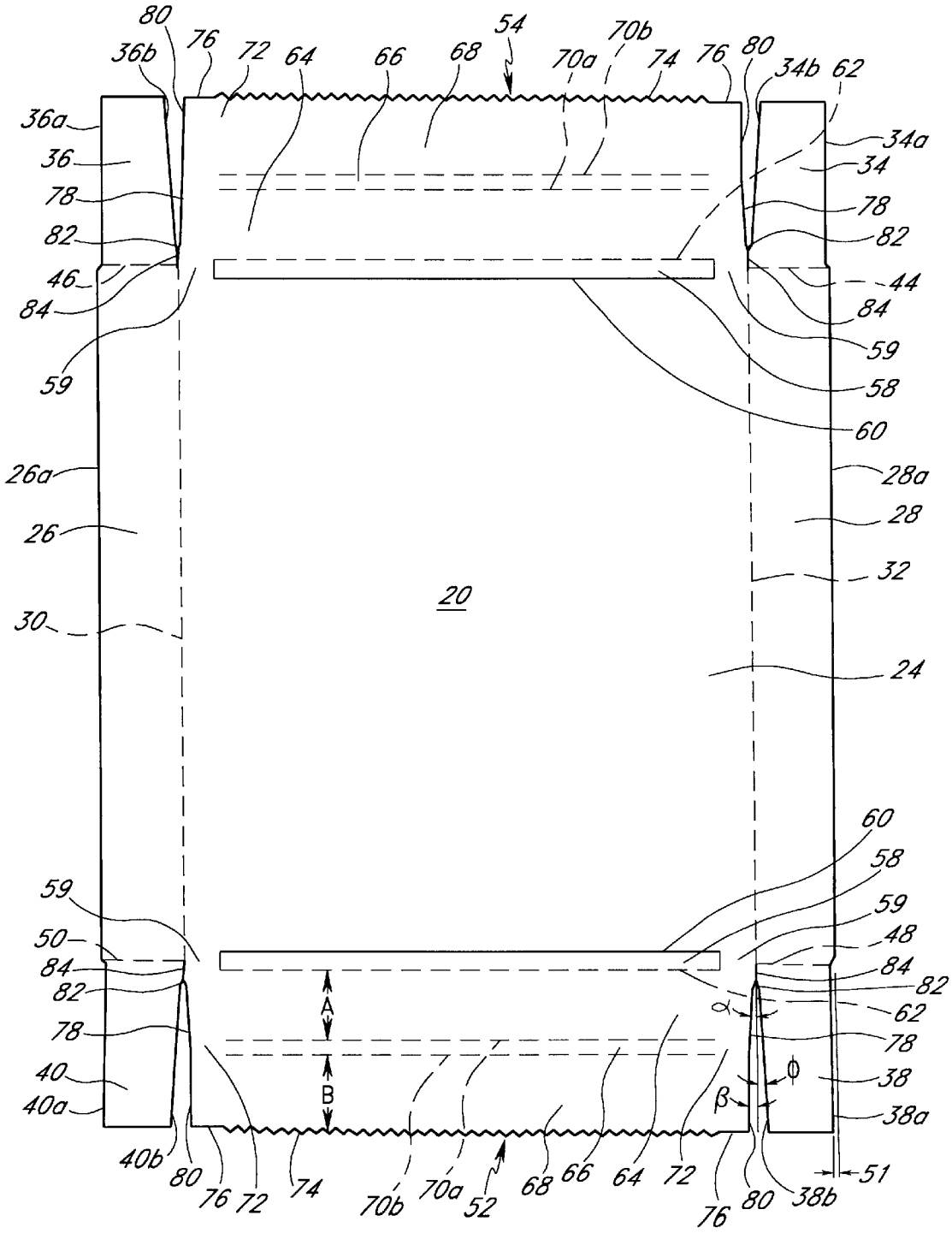
FIG. 1 is a plan view of the blank adapted to form the die cut lock tray of the present invention.

FIG. 1 shows a die cut blank 20 for a tray 22 (FIG. 3) having a generally rectangular shape having a length greater than its width. Trays 22 having other shapes can be used, and the die cut blank 20 for such trays can be modified suitably using disclosures herein. FIG. 1 shows the interior of the blank 20, which will face the interior of the tray 22 when assembled. As used herein, a reference to an inner part or inwardly located part will refer to one located closer to the center of the tray 22, and a reference to a distally located part will refer to a part located further from the center of the tray 22. Reference to a distal part will refer to a part most distant from the center of the tray.

The blank 20 has a central portion 24, opposing sides 26, 28 connected along the longer side of the central portion, and separated from the central portion by side perforation lines 30, 32, respectively. The side perforation lines 30, 32 are ¼ by ¼ perforations, when the blank 20 is made of 150 C flute, single wall corrugated board. It could be made of other material or of other corrugated material, but corrugated paper is preferred. Other sized perforations can be used if appropriate adjustments are made to accommodate the material used and other teachings of this disclosure. Advantageously, the perforation lines 30, 32 are scored as well as perforated in order to make it easier to bend along the lines and form the tray 22 using automated equipment. It is believed advantageous to have the perforations extend through the entire thickness of the material of blank 20, and that is the case for all the perforations described in the blank.

For illustration purposes, the tray 22 will be described relative to a tray used to bake a sheet cake. In this illustrated use, the central portion 24 corresponds to the bottom of the tray. For ease of illustration, the central portion 24 will be referred to in the description as the bottom. For illustration purposes a tray for a half sheet cake is described. The overall dimensions from the distal edge 74 on opposing sides of the blank 20 is about 20.3 inches. The overall dimension from the distal edges 26*a* to 28*a*, is about 19.1 inches. The bottom 20 will be about 12 inches between slit lines 60, and about 15.7 inches between side perforation lines 30, 32. In the illustrated embodiment, the sides 26, 28 are as long as the length of the bottom 20, and about 1.75 inches from the distal edges 26*a*, 28*a*, to the adjacent perforation 30, 32.

Tabs 34, 36, 38, 40 are connected to and extended from opposing ends of the sides 30, 32 along the length of the sides. A perforated tab line 44 extends between the end of the side 28 and tab 34, perforated tab line 46 extends between tab 36 and side 26, perforated tab line 48 extends between the end of side 28 and tab 38, and perforated tab line 50 extends between the end of side 26 and tab 40. The tab perforation lines 44, 46, 48, 50 are preferably ⅛ by ⅛ perforations. Other sized perforation can be used if appropriate adjustments are made to accommodate the material used and other teachings of this disclosure. Advantageously, the lines 44, 46, 48, 50 are scored as well as perforated in order to make it easier to bend along the lines and form the tray 22 using automated equipment.

The tabs 34, 36, 38, 40 each have an exterior edge 34*a*, 36*a*, 38*a*, 40*a* that is slightly undercut by an amount 51 (FIG. 1) so they do not have the same width as the sides 26, 28, and so they do not extend parallel with the exterior edges 26*a*, 28*a* of the side to which the tabs are attached. In the illustrated embodiment, the tabs are about 4 inches long, and the undercut 51 is about 0.1 inch from a line along the exterior edge 26*a*, 28*a* along the entire length of the tab.

The tabs 34, 36, 38, 40 each also have an interior edge 34*b*, 36*b*, 38*b*, 40*b*, each of which is opposite the respective exterior edge 34*a*, 36*a*, 38*a*, 40*a*. The interior edge extends at an angle $\phi$ from a line parallel to, or aligned with, perforation lines 30 or 32. The angle allows the tabs to fold easier over the bottom 20.

Extending from opposing ends of the bottom 24 are end rolls 52, 54 each of which is separated from the bottom 24 by a crushed area 58. The crushed area 58 is a crushed or compacted area of the corrugated or other material from which the blank 20 is made. The crushed areas 58 are preferably rectangular, extending almost the entire width of the bottom 24, but stopping about short of each of the perforated lines 30, 32, preferably leaving an uncrushed area 59 on opposing ends of each crushed area. The depicted crushed areas 58 are each about 0.4 inches from the slit 60 to the perforated edge 62, and extend to almost the perforated fold lines 30, 32, but terminate before reaching the fold lines to form the uncrushed areas 59, which are about 0.7 inches long.

On the smaller ends of the crushed area and the long side located toward the bottom 24, the crushed areas 58 are each bounded by a slit-score line 60. On the side located away from the bottom 24, each crushed area 58 is bounded by a perforation line 62. The perforation line 62 is preferably ⅛×⅛ perforations, although other perforations can be used with suitable variations of the material and considering the disclosures herein. Advantageously, the perforation line 62 is scored as well as perforated in order to make it easier to bend along the lines and form the tray 22 using automated equipment. The slit-score line 60 is advantageously formed by scoring with the edge bevel facing inward toward the crushed area 58. The slit-score line 60 does not cut all the way through the blank 20. Preferably, the blank 20 is formed of two opposing sheets of liner with fluting between the liner. The slit-score line 60 preferably cuts through the interior liner and the fluting, but not through the exterior liner. The crushed areas 58 are advantageously produced by a die having cork located to crush the bottom 24 at the desired locations, with the cork height extending slightly beyond the blade so that the crushing and slitting operation occurs in the same step. Slitting to C flute corrugated (thickness about 0.142 inches without facings or linings) to a depth of about 0.923 inches is believed suitable.

The crushed areas 58 are located so that a line extending between the tab perforation lines 46, 44, and between tab perforation lines 48, 50, falls roughly in the middle of the crushed areas 58. Advantageously, that line falls slightly off-center, away from the bottom 24. Preferably, the perforated line 62 that defines one side of each crushed area 58 is offset from the line joining perforation lines 48, 50, and the line joining perforated lines 44, 46, by an amount equal to the thickness of the material from which the end rolls 52, 54 are formed.

The end rolls 52, 54 further comprise a inner, first portion 64, a middle, second portion 66, and a distal, third portion 68. The first portion 64 extending along the width of each end roll 52, 54, is located closest to the bottom 24, and borders on the crushed areas 58. The second portion comprises a narrow strip extending across the width of each end roll 52, 54 and is advantageously defined by parallel, perforated lines 70*a*, 70*b*, with perforated line 70*a* being closer to the bottom 24 as shown in FIG. 1. The perforated lines 70*a*, 70*b* are advantageously ⅛×⅛ perforations, although other perforations could be used giving consideration to the disclosures of this application. Advantageously, the perforated lines 70*a*, 70*b* are scored as well as perforated in order to make it easier to bend along the lines and form the tray 22 using automated equipment. The perforated lines 70*a*, 70*b* advantageously terminate before reaching the sides of the end rolls 52, 54. For the illustrated embodiment, the lines

70*a,* 70*b* terminate about 0.4 inches from the sides, leaving an unperforated space 72 on opposing ends of the second portion 66.

The distal, third portion 68 extends from the second portion 66 to the distal end of each end roll 52, 54. That distal end advantageously comprises an edge 74 having generally triangular serrations extending a predominate length of the edge. The serrations are advantageously formed by a medium angle wave rule (2 pt. thickness) that produces serrations that are generally triangular shaped, about 0.2 inches at the base and about 0.1 inch high. The serrations preferably do not extend along the entire length of the edge 74. There is a bumper portion, shown as a flat, non-serrated bumper portion 76 on each end of the edge 74. The serrated edge extends beyond the bumper portion 76. Other variations on the serrated edge 74 can be used, and will especially be likely to vary as the material used to make the tray varies. Thus, for example, a serrated edge 74 made by a wave rule 1.5 pt, coarse angle, 0.937 is believed suitable for use with a 200# C flute, single wall corrugated material.

The sides of the end rolls 52, 54 are angled. The sides 78 of the first portion 64 are angled at an angle $\alpha$ relative to a line aligned with, or parallel to the side perforation line 30 or 32 to provide further clearance. The sides 80 of the second and third portions 66, 68 are angled at an angle $\beta$ relative to a line aligned with, or parallel to the side perforation line 30 or 32 to provide further clearance, although preferably the sides 80 are perpendicular to the distal, serrated edge 76, and parallel to perforation lines 30, 32. These angles provide a taper that makes it easier to fold the portions 64, 66, 68 and form the end rolls 52, 54 for the tray 22. Advantageously, the distance between the corner of distal portion 68 adjacent the flat portion 76, and the adjacent corner of the tab 38 along inner edge 38*b,* is about twice the thickness of the sheet of material 20, with the angles $\alpha$, $\beta$ and $\phi$ providing this clearance.

The taper between the sides 78, 80 and the corresponding sides 34*b,* 36*b,* 38*b,* 40*b* converges to a point 82 near the end of side perforation lines 30, 32 and at that termination point 82 there is advantageously a taper of about 1/16 inch radius to avoid tearing. The termination point 82 is about 0.5 inches from each of the tab perforation lines 44, 46, 48, 50. A slit 84 extends from the termination point 82 to the adjacent perforation line 44, 46, 48, 50.

Further, a major portion of the tabs 34, 36, 38, 40 are crushed during formation of the blank 20. In particular, the distal portion of the tabs are crushed, beginning at a line parallel to perforation lines 44, 46, 48, 50, which extends through the termination point 82. This crushing makes it easier to position the tabs during automated assembly, and also makes the tabs thinner so when they are interleaved in the end rolls during formation of the tray (as described later), they do not take up as much room.

Given the above information, one skilled in the art can form a die cut blank 20 to the specifications described and discussed herein, and devise further variations using a variety of corrugated or other material for the die cut blank 20. For example, the sides 26, 28 could be rolled instead of the ends of the box. The interlocking parts need not occur on the ends, but could be formed on the sides.

Preferably the die cut blank 20 is formed on a platen die cutter rather than a rotary cutter, because it is difficult for the rotary cutter to maintain sufficiently precise tolerances. The platen die cutter will have projecting cutters at the location of each perforation described above, and will have cutting edges located so as to define the periphery of the blank 20. Further, cutting blades will be correspondingly positioned to cut the slits as described. Moreover, incompressible material such as cork or rubber will be positioned at locations corresponding to the crushed areas, and of suitable height, to crush the blank 20 at the described locations. Finally, scoring edges will be located on the cutting die so as to score the blank 20 at the above described score locations. Given the description of the blank 20, one skilled in the art can devise a suitable die, and thus the die is not depicted or further described herein. Preferably, an automated feed platen die cutter is used to speed production of the blanks 20.

Tray Formation

Referring to FIGS. 1–5, and 7, the assembly of the tray 22 will be described. The die cut blanks 20 are formed into trays by an automated machinery which is known in the art and not described in detail herein. The die cut blanks 20 are loaded, 100 at a time, into a loader or magazine. A vacuum chuck pulls the blanks 22, one at a time out of the loader and supports the bottom 24 while the various tabs, ends and sides are folded and tucked to form the tray 22.

In more detail, the bottom 24 is supported while the peripheral portions of the blank are bent generally perpendicular to the bottom to form side walls. The sequencing can vary slightly, but preferably the tabs 34, 36, 38, 40 are folded along perforated lines 44, 46, 48, 50 perpendicular to the bottom 20. Next, the sides 26, 28 are folded along lines 30, 32 to place the sides perpendicular to the bottom 20, and the tabs over the crushed portions 58. If the tabs begin folding before the sides 26, 28, it is easier to avoid the tabs hitting the end rolls 52, 54. The prior crushing of a major portion of the tabs makes them easier to position with the automated equipment. The end rolls 52, 54 are then folded perpendicular to the bottom 24 to achieve the configuration shown generally in FIG. 2, and in FIG. 6.

Figure 2:
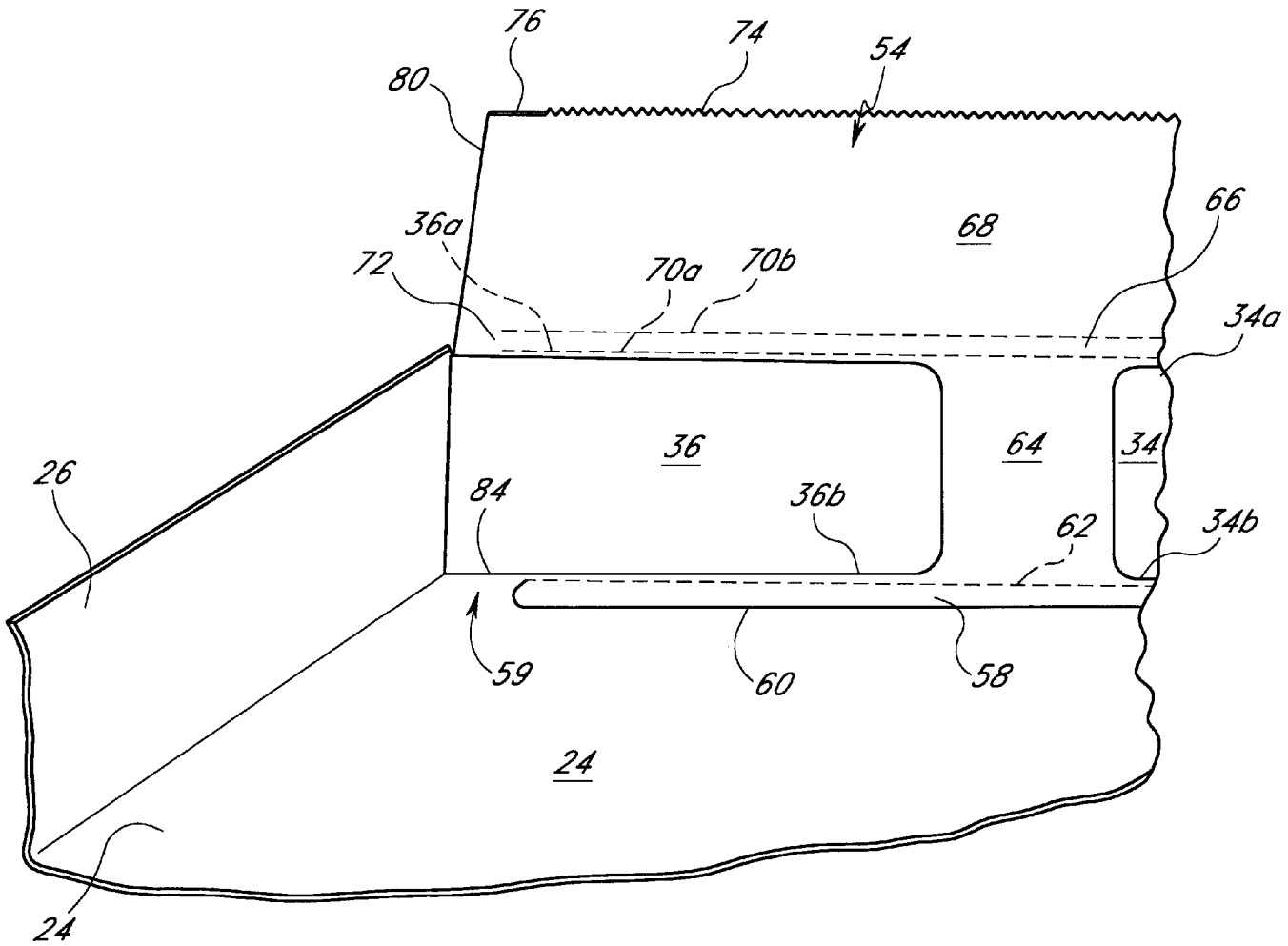
FIG. 2 is a perspective view of one corner of the tray assembled from the blank of FIG. 1, with the other corners being similarly constructed.

As seen in FIG. 2, the tab 36 abuts the first portion 64 of the end roll 54, with the bottom 24 creasing along the outer portion of the crushed area 58 along perforated line 62. The first portion 64 forms an end of the tray. The tab 36 extends over a portion of the crushed portion 58 adjacent to and along perforated line 62. The flat, untapped slit 84 extends over the uncrushed area 59. The non-serrated bumper portion 76 is aligned with the uncrushed area 59, while the serrated edge 74 is aligned with the crushed portion 58. The other corners are similarly positioned, and are not described in detail.

Figure 3:
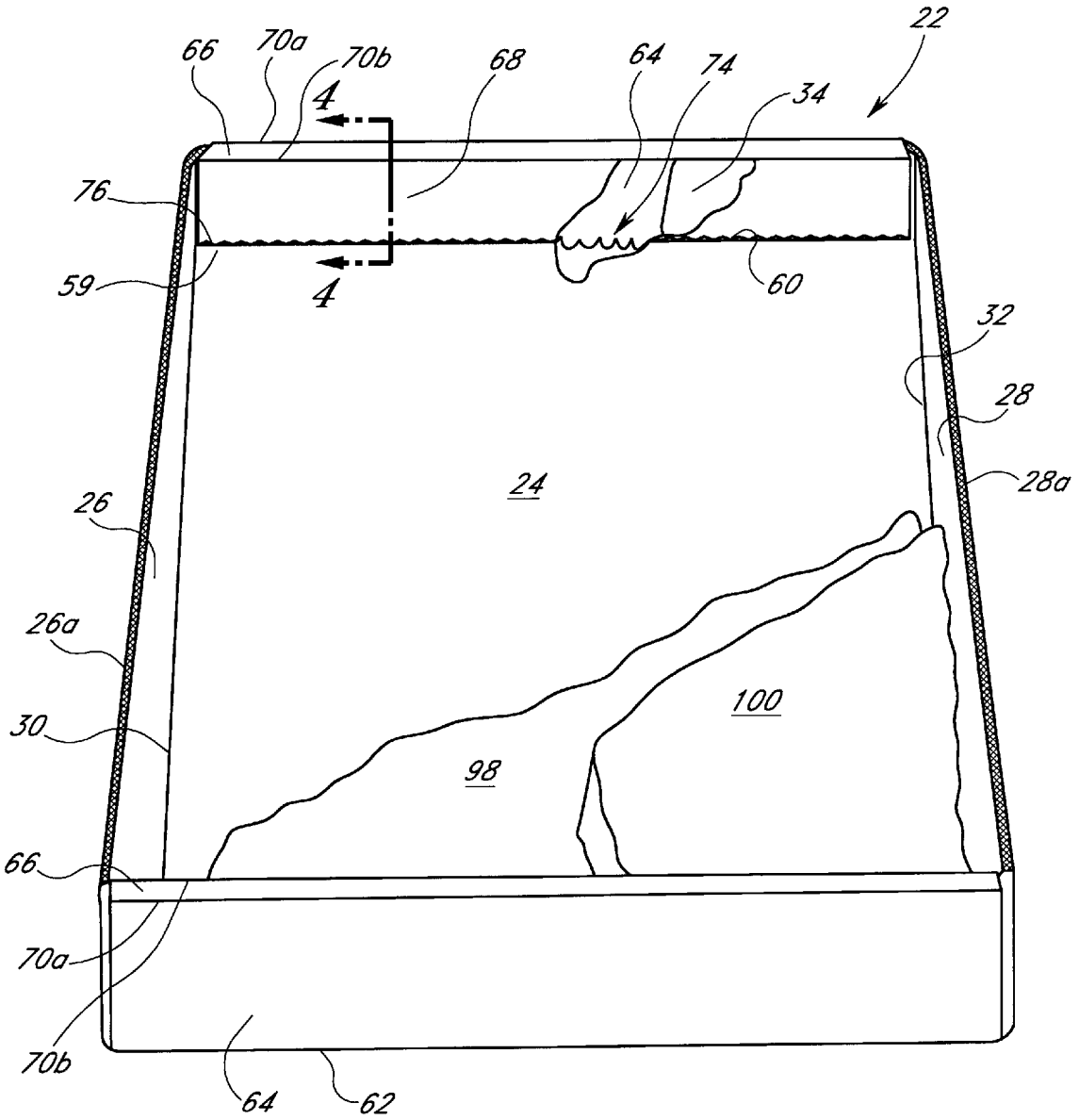
FIG. 3 is a perspective view of an assembled tray using the blank of FIG. 1

To complete the assembly to achieve the tray of FIG. 3, the second portion 66 folds along perforation lines 70*a,* 70*b,* and rests against the top edge 36*a* of the tab 36 to form a rectangular, top edge at the end of the tray 22. The recess 36*a* corresponds to the thickness of the materials of the second portion 66 to provide a uniform edge round the entire periphery of the tray 22. The unperforated end portions 72 help prevent tearing of the edge.

Figure 4:
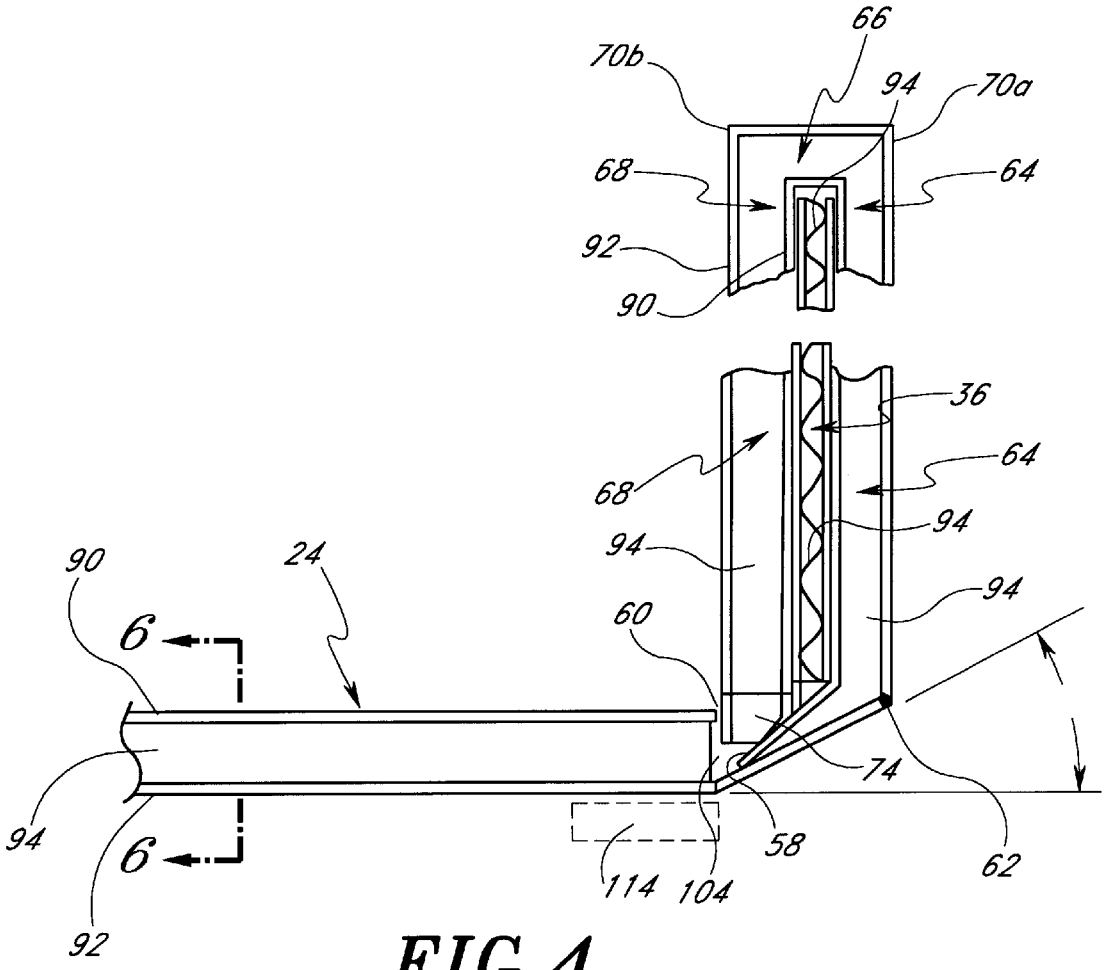
FIG. 4 is a sectional view taken along line 4—4 of FIG. 3.

The third portion 68 is then folded so that it ends up parallel to the first portion 64, and perpendicular to the second portion 66 to form an end of the tray 22 located on the inside or interior of the tray. Thus, the third portion 68 abuts tab 36. The serrated edge 74 enters the crushed portion 58 to interlock the end roll 54 as seen in FIG. 4. Because the end roll 54 want to unroll or unfold, the serrated edge 74 is resiliently urged against the lip formed by the slit-score line 60 to further interlock the parts.

Referring additionally to FIG. 4, the non-serrated bumper portion 76 abuts the uncrushed portion 59 to limit the depth to which the serrated edge 74 can enter the crushed portion 58. That helps prevent bending and crushing of the serrated edge 74 by forcing the serrated edge 74 against the bottom of the crushed area 58. To reduce or avoid crushing of the serrations on serrated edge 74, it is advantageous to crush the areas 58 as much as possible without penetrating the exterior liner of the bottom 24. The area 58 must be crushed at least past the inner liner of the bottom 24 to form a lip so the serrated edge can engage the lip.

To assist the formation of the end roll 54 with suitable interlocking characteristics, the width A of the first portion, measured between perforation lines 62 and 70*a,* is preferably less than the width B of the third portion 68, measured between perforation line 70*b* and the base of the serrations on the serrated edge 74. Advantageously, the width B of the third portion 68 is about 1/16 to 3/32 of an inch longer than the width A of first portion 64. This increased length ensures the serrated edge 74 is inserted into the crushed area 58 a distance sufficient to allow the serrations on the serrated edge 74 to engage the lip formed by slit 60.

Advantageously, as the third portion 68 rotates about the second portion 66 and exterior edge 36*a* (and 34*a*—not shown), the serrated edge 74 does not hit or scrape along the bottom 24 a degree sufficient to bend the serrations on the edge 74. Thus, preferably the serrated edge 74 is inserted into the crushed portion 58 without being permanently deformed. The same applies to the opposing end roll 52.

The insertion without bending the serrations on the serrated edge 74 can be achieved by adjusting the timing and sequence of formation, in part by bending the third portion 68 before completely bending the first portion 64 perpendicular to the bottom 24. Alternatively, if the first portion 64 is perpendicular to the bottom 24, then the third portion 68 must be bent along the more distal fold line 70*b* before the second portion 66 is placed parallel to the bottom 24. Once the second portion 66 is placed parallel to bottom 24 to form the top edge along the end of the tray 22, then the third portion can only rotate along perforation line 70*b* and that will result in the serrated edge 74 scraping along the bottom because the width B of the third portion 68 is greater than the width A of the first portion 64.

As the third portion 68 rotates or pivots into position, the serrations on the edge 74 may bend slightly as they hit the bottom 24. The direction of the bend can cause the serrated edge to extend slightly under the lip formed along slit 60 as best seen in FIG. 4. Such a slight bend is advantageous for ensuring engagement between the serrated edge 74 and the crushed area 58 (or 58). But if the serrations 74 bend too much, then the bend hinders engagement with the lip along slit 60, and indeed the bent serrations may catch on the lip and prevent the edge 74 from entering the crushed area 58 (or 58). Appropriate engagement could be achieved with bent serrations on the edge 74 by running a person's fingers along the slits 60, or by mechanically running a ruler, edge, rotating disc or roller along the slits.

The tray is preferably assembled by automated equipment, pneumatically driven, to position the tabs, end rolls, and various parts of the tray. The automated equipment forces the serrated edge 74 toward the inner portion 64 and intervening tabs 34, 36, 38, 40 so the serrated edge 74 can be pushed into the crushed area 58 by a force applied against the middle portion 66 which forms a top edge of one wall of the tray when assembled. One advantage of crushing the area 58 in addition to exposing the lip by slit 60, is to weaken the area and allow insertion of the serrated edge 74 by automated equipment. To support the blank 20 during this insertion portion of the assembly, a support plate 114 (FIG. 4) may be placed along the length of slit 60 but on the unslit side of the blank 20. By effectively supporting the area of the blank 20 along the slit lip 60 and leaving the crushed area 58 unsupported, the serrated edge 74 can be securely inserted in to the crushed area 58. But because the uncrushed area 58 is unsupported during insertion, the force of insertion must be controlled or the serrated edge will tear through the blank 20.

As seen best in FIG. 4, folding the end rolls 52, 54 and inserting the serrated edge 74 into the crushed areas 54, 58 to form the interlock, causes the tray 22 to have an inclined edge along a length corresponding to the length of the crushed area. This incline θ is about 30° relative to the plane of the central portion, or bottom 24 of the blank 20. The perforations 62 bounding the distal side of the crushed areas 54, 58 define one edge of the inclined edge. If the perforations 62 do not extend all the way through the material of the blank 20, the edge does not form distinctly. If the perforations are too long or do not leave enough material, then the edge is effectively a slit edge and the tray is weakened. If the perforations are too short or spaced too far apart, the edge does not form distinctly, which makes it more difficult to square the corner, and impeded automated assembly with sufficiently high repeatability and reliability. Similar considerations exist with the other perforations in the blank 20.

As also best seen in FIG. 4, because the crushed area 58 is inclined, its traverse length is shorter than the actual length as measured along the surface of the blank 20 (FIG. 1). Thus, the length of the crushed area from slit 60 to perforation 62 is greater than the thickness of the inner, and outer portions 64, 63 and the interposed tab, 34, 36, 38, 40. Crushing the tabs 34, 36, 38, 40 to reduce the thickness is also taken into account in determining the dimension of the crushed area 58.

In order to assist proper engagement of the serrated edges 74 and the crushed areas 58, it is advantageous to have the portions 59 remain uncrushed. If the crushed portions 58 extend all the way across the width of the bottom 24, then the end rolls 52, 54 tend to form in the crushed portions 58 or along the slit edge 60 which can cause the end rolls 52, 54 to form so that the serrated edges 74 hit the bottom 24 and unacceptably bend the serrations or possibly be forced completely through the material of blank 20. Thus, it is preferable to have the uncrushed portions 59 on opposing ends of the crushed areas 58, and to have the uncrushed portions 59 of sufficient size so they urge the formation of the fold line between bottom 24 and first portions 64 to occur along perforation lines 62 along the outer edge of the crushed areas 58.

Further, if the uncrushed areas are too small, the automated assembly equipment cannot form a square corner and the shape of the tray is unstable and inconsistent, which can result in the serrated edge 74 scraping along the bottom 24 and unacceptably deforming the serrated edge 74. The slit 84 also helps the automated equipment to square the corners of the tray 22 by ensuring bending of the tabs along the perforated lines 44, 46, 48, 50.

There is thus advantageously provided a die cut blank 20 that can be assembled by automated equipment into a tray 22. The tray 22 has no holes in the bottom 24 of the tray through which the contents of the tray can escape or leak out. The use of serrations along the serrated edge 74 provides a gripping edge to engage the lip formed along the slit edge 60 of the crushed areas 58. The interlocking of the serrated edge 74 with the crushed areas 58 provides a mechanical interlock.

Advantageously, all the serrations along the length of the serrated edge 74 enter the crushed portion 58 a degree sufficient for the serrations to engage the lip formed by the slit 60. If an insufficient portion of the serrated edge engages the lip formed by slit 60, the tray will not hold its position. Scraping the serrated edge 74 along the bottom 24 can cause the thin inner layer 90 (FIGS. 4–5) at the tip of each serration to bend, and that bent portion can catch on the exterior surface of the bottom 24 adjacent edge 60 and prevent one or more serrations along serrated edge 74 from entering the crushed area 58 and interlocking.

Figure 5:
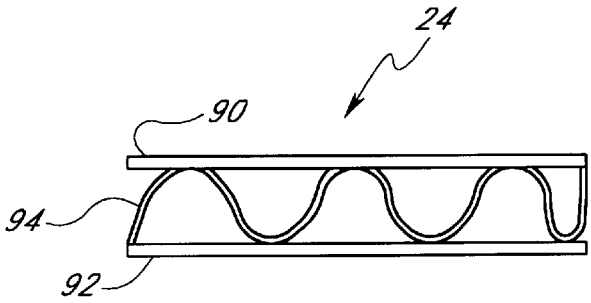
FIG. 5 is a sectional view taken along line 6—6 of FIG. 4.

If less than 40% of the length of the serrated edge 74 is engaged with the lip formed by the cut-score line 60, then the lock formed between the serrated edge 74 and the lip will probably be marginally acceptable, but not likely to consistently and repeatably hold during use of the tray. Preferably at least 60% of the serrated edge 74 is engaged with the lip formed by slit-score line 60. In forming the crushed areas 58, it is advantageous to crush the areas sufficiently to form a lip that extends above the crushed areas. When the crushed areas are formed in corrugated material having inner and outer liners 90, 92 separated by a flute 94 as shown in FIGS. 4–5, it is advantageous to crush the flute sufficiently that the outer liner 90 is clearly separated, and can be seen. This requires crushing the areas 58 sufficiently so the flute does not rebound to place the outer liner 90 adjacent the outer liner 90 on the uncrushed portion of the bottom 24. Alternatively phrased, the slit 60 separates the outer liner 90 along the length of the crushed area 58, and the crushed area is crushed sufficiently so the liner 90 associated with the crushed area is below the outer liner 90 of the adjacent, uncrushed bottom 24. The crushed area 58 must remain sufficiently crushed to allow locking access to the lip formed along the slit 60, by the serrated edge 74.

The engagement of the serrated edge 74 with the lip formed by the slit-score line 60 is more important at the corners of the tray 22 than at the middle of the serrated edge 74. Thus, if less than optimum interlocking is used, it preferably occurs at the corners of the tray, and along the ends of the serrated edge 74 toward the bumper portions 76.

Various serrations can be used along the serrated edge 74. The serrations are preferably uniform along the serrated edge 74. If the serrations along the serrated edge are too large, then it is more difficult to engage them with the crushed areas 58 and the failure of one serration to engage greatly reduces the locking effect of the interlock. If too small, the serrations do not easily catch on the lip formed by the slit-score line 60, and that reduces the locking effect of the interlock. The triangular shaped serrations are preferable, but other shapes are believed to be suitable. Given the wide variety of corrugations available, various serrated edges 74 can be devised for particular constructions of the die cut blanks 20, given the teachings herein.

Referring to FIGS. 4–5, the die cut blank 20 is advantageously made of 150 pound, C flute corrugated material having an sheet of inner liner 90, an opposing and parallel sheet of outer liner 92, and an intermediate, undulating flute 94. The inner and outer liners are 33# each, and the medium or flute 90 is 26#. C flute has 36 to 42 flutes per foot and is about 0.142 inches thick, not including the thickness of the facings or liners 90, 92. Thinner, B flute material was tried, but it did not work as well with the machine folding. Even for the same material, such as 150 C flute corrugated, the repeatability of automated production and assembly can vary with the fiber strength, the moisture, and the percent of recycled material in the corrugated. The B flute material is about 0.136 inches thick. But there are a wide variety of combinations of liners 90, 92 and flutes 94 that could be used and adapted to achieve the objectives of this invention given the disclosures herein.

As shown especially in FIG. 4, the slit 60 forms a lip on the inner liner 90, which lip that extends slightly into a recess 104 formed by the crushed area 58. The lip engages the serrated edge 74 to interlock the serrated edge and distal, third portion 68 to the central portion or bottom 24. If the serrated edge 74 is bent toward the lip formed by the cut 60, the interlocking is further enhanced. The lip formed by slit 60 is advantageously visually perceptible along the entire length of the slit, and can be caught with a fingernail.

Given the above information, one skilled in the art can form a tray 22 to the specifications described and discussed herein, and devise further variations using a variety of corrugated or other material for the die cut blank 20 and tray 22. For example, the interlocking parts need not occur on the ends, but could be formed on the sides, so the sides 26, 28 could be rolled instead of the ends of the tray.

Use of the Assembled Tray 22

The tray 22 formed by the interlocking of the serrated edge 74 with the slit-score line 60 and crushed area 58, has many uses. But because the tray 22 forms a secure, interlocked tray having no holes in the bottom, it has particular application in the food industry. One such application is for baking sheet cakes, as described below.

Figure 6:
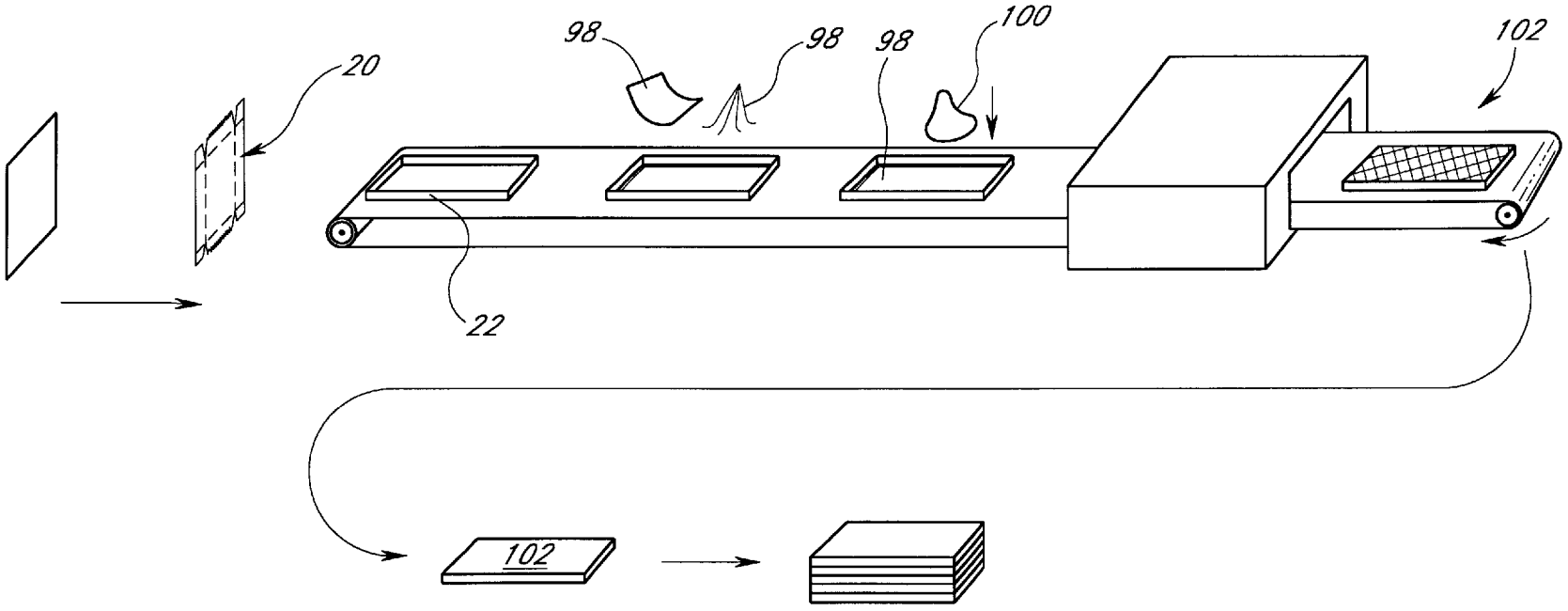
FIG. 6 is a flow diagram showing the fabrication, assembly and use of the blank of FIG. 1 and the tray of FIG. 3.
Figure 7:
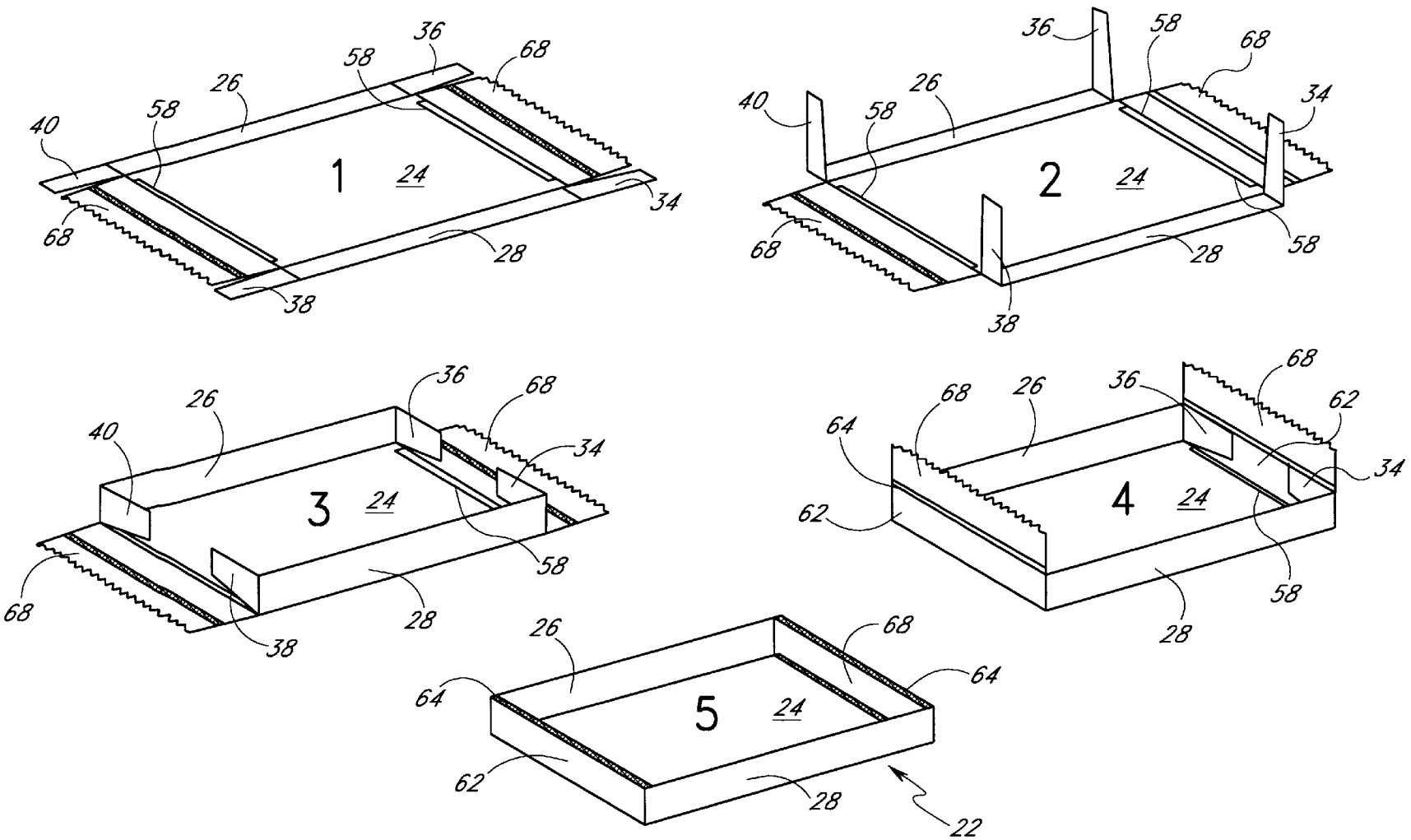
FIG. 7 shows the sequence by which a die cut blank of FIG. 1 is formed into the tray of FIG. 3.

Referring to FIG. 6, after being formed by the automated equipment, the assembled tray 22 is then placed on an assembly line. A release material 98 (FIG. 3) is placed on the formed tray 22. The corrugated cardboard will absorb liquids and stick to many food materials. Thus, it is advantageously coated with a release material 98 to prevent the food material from being absorbed by and sticking to the tray 22. The release material 98 can comprise a sheet of liner material placed on and substantially covering the bottom 24 of the tray 22. Wax paper is commonly used for the release material 98, and is partially shown in FIG. 3. The wax paper can be manually placed in the tray, or it can be placed by automated equipment that cuts a sheet of paper of appropriate length from a roll, and uses gravity or pneumatics or a vacuum chuck to position the paper in the tray 22. Alternatively, a cooking compatible oil or grease, or a release agent, possibly Michelman 50A or H, can be sprayed or otherwise deposited on the bottom 24, or even on the bottom and sides and ends of the tray 22. This Michelman release agent is available from Michelman Inc, in Cincinnati, Ohio. It is a polymer having about 35% total solids with water as the volatile compound. It has water as the volatile compound. It has a Brookfield viscosity at 23° C. of about 150–850 cps, on a #3 spindle at 60 rpm. It has a pH of 8.8–9.8, a specific gravity of 0.96–1.01. The release agent can be applied by spraying or the application can be either manually or automated. It could even be applied to the die cut blank 20 before it is assembled into the tray 22. For use in the food industry, the release material must be non-toxic and compatible with human consumption of the food placed against the release material.

A food material 100, such as cake batter, is then placed on the bottom 24 of the tray 22 by dispensers known in the art and not described in detail herein.

The conveyor then places the tray 22 and food material 100 into an oven where the food material is baked. For cake batter, it may bake about 40 minutes at about 300–400° F. The result is a cake baked in the tray 22. The baked cake 102 is then cooled, placed in a freezer and frozen. The frozen cakes are packaged in cases, typically four cakes per case, and shipped to retailers for sale. Thousands of cakes per day can be made using the trays 22.

In view of the above disclosure, one skilled in the art can make variations of the invention that are within the scope of this invention. Thus, for example, the middle portion 66 can be omitted and the perforated fold lines 70*a*, 70*b* consolidated into one line. Further, the flat portion 59 on the serrated edge 74 could be located anywhere along the edge, and cooperate with a uncrushed portion correspondingly located on the central portion or bottom 24 to limit insertion of the serrated edge into the crushed portion 58. Moreover, the description is for use with containers having four walls, but the serrated edge 74 interlocking with the lip on the crushed area 58 can be used on containers having any number of walls. Additionally, the interlocking mechanism disclosed herein is advantageously used on opposing walls of the container, but could be used on a single wall of a multi-walled container. Similarly, the serrated edge 74 is shown as a continuous serration engaging a correspondingly continuous elongated crushed area 58 and corresponding elongated lip formed by slit 60. But the serration could be intermittent along the length of the edge 74, and the crushed area and lip could be formed in the central portion 24 to correspond to the location of the serrations.

The above description is thus given by way of illustration, not limitation, and the claims appended hereto are to be given their broadest reasonable interpretation consistent with this disclosure and consistent with the spirit and scope of this invention, as defined in the following claims.

What is claimed is:

1. A die cut blank, comprising:

a planar sheet of material having a central portion;

two side portions, one each on opposing sides of the central portion and adapted to fold perpendicular to the central portion along a side fold line interposed between each side and the central portion;

four tabs, one each extending along a length of each side and from an opposing end of each side, the tabs adapted to fold perpendicular to the side along a tab fold line interposed between each tab and the adjacent side;

two crushed areas, one each located at opposing ends of the central portion and between the sides, the crushed areas extending adjacent to, but not all the way to each side, a slit defining a lip along a substantial length of each crushed area, the lip being located on a side of the crushed area located toward the central portion, the crushed area being crushed sufficiently to allow locking access to the lip but not forming an opening extending entirely through the sheet of material;

two end roll portions, one each on opposing ends of the bottom and located between two tabs, each end roll located distal of the crushed areas and comprising an inner portion and a distal portion, the inner portion being adapted to fold along an inner fold line along a distal side of the crushed area located away from the central portion, the inner fold line being perforated through the sheet of material, the inner and distal portions being separated by an intervening fold line, the inner and intervening fold lines being parallel and perpendicular to the side fold lines, a distal edge of the distal portion having a serrated edge;

wherein the inner and distal portions are sized to fold about the intervening and inner fold lines to place the serrated edge into the crushed area so the lip engages the serrated edge, and wherein the tabs are configured to be placed inside the adjacent, folded inner and distal portions.

2. The die cut blank of claim 1, wherein the blank is made of C flute cardboard.

3. The die cut blank of claim 1, wherein the tabs have an outer edge that is recessed from a line extending along a distal edge of the sides, the amount of the recess being about the thickness of the material.

4. The die cut blank of claim 1, wherein a bumper portion is formed on the serrated edge.

5. The die cut blank of claim 1, wherein the tabs and end rolls are separated by a space sufficient to allow assembly by automated machinery.

6. The die cut blank of claim 1, wherein between the inner and outer portions of the end roll is located a middle portion, separated from the inner portion by an additional fold line parallel to and inward from the intermediate fold line, the additional and intermediate fold lines being spaced close enough together to define a top edge of a box formed from the blank.

7. The die cut blank of claim 1, wherein the sides have a length that is shorter than the ends.

8. The die cut blank of claim 1, wherein the inner portion has a width A that is slightly less than a width B of the distal portion so as to place the serrated edge into the crushed area.

9. A die cut blank made of a sheet of material that may be folded to form a container having a plurality of walls surrounding a central portion, the blank having a cut line bordering on a crushed area having a reduced thickness sufficient to expose a lip along a length of the cut line, a perforation line being located parallel to the cut line on an opposing side of the crushed area to define a fold line, a end roll being located adjacent the crushed area and having at least one additional fold line located to allow a distal, serrated edge of the end roll to be placed into the crushed area and engage the lip along a sufficient length of the exposed lip to interlock the serrated edge in the crushed area and form one of the walls of the container when the blank is formed into the container.

10. The die cut blank of claim 9, wherein there are two crushed areas, each on opposing sides of the blank, each with a cut line bordering the crushed area and exposing a lip along a length of the cut line, and wherein there are two end rolls configured to allow a distal, serrated edge of the end roll to be placed into the crushed area and engage the lip along a sufficient length of the exposed lip to interlock the serrated edge in the crushed area and form a wall of the container when the blank is formed into the container, and wherein neither the cut line nor the crushed area extend entirely through the sheet of material.

11. The die cut blank of claim 9, wherein the crushed area has opposing ends and there is a non-crushed area on each end of the crushed area, the non-crushed area being interposed between the crushed area and a wall folded perpendicular to the central portion of the sheet when the sheet is formed into the container.

12. The die cut blank of claim 11, wherein there are end tabs formed on a plurality of corners of the sheet, and wherein the end tabs are located and adapted to be folded about lines that allow the end tabs to be intermediate opposing sides of the end rolls when the blank is formed into the container.

13. A container formed from a sheet of material, comprising:

a plurality of walls surrounding a central portion, adjacent the base of one wall the central portion containing a cut line bordering on a crushed area having a reduced thickness sufficient to expose a lip along a length of the cut line, a end roll being located adjacent the crushed area and having fold lines parallel to the cut line and located sufficient to allow a distal, serrated edge of the end roll to be placed into the crushed area and engage the lip along a sufficient length of the exposed lip to interlock the serrated edge in the crushed area and form one of the walls of the container, neither the cut line nor the crushed area extending entirely through the sheet of material and at least one of the fold lines being located parallel to the cut lines and located on an edge of the crushed area opposite the cut line, and a portion of a wall adjacent said one of the walls, being held in position by the end roll.

14. The container of claim 13, wherein there are two crushed areas, each on opposing sides of the container, each with a cut line and fold line bordering opposite elongated edges of the crushed area and exposing a lip along a length of the cut line, and wherein there are two end rolls configured to allow a distal, serrated edge of the end roll to be placed into the crushed area and engage the lip along a sufficient length of the exposed lip to interlock the serrated edge in the crushed area and form walls of the container.

15. The container of claim 13, wherein there is a non-crushed area on opposing ends of the crushed area, the non-crushed area interposed between the crushed area and an adjacent wall.

16. The container of claim 13, wherein there are end tabs formed on a plurality of corners of the sheet, and wherein the end tabs are located and adapted to be folded about lines that allow the end tabs to be positioned between and held by opposing sides of the end rolls.

17. The container of claim 13, wherein the serrated edge includes a bumper portion positioned to engage an uncrushed portion on the central portion so as to limit the distance the serrated edge can be inserted into the crushed area.

18. The container of claim 13, wherein the serrated edge comprises generally triangular serrations about 0.2 inches wide at the base and about 0.1 inch high at the apex of the triangle, and wherein the material comprises C flute corrugated paper.

19. The container of claim 13, wherein the end rolls include an inner portion and a distal portion with at least one fold line intermediate those portions, and wherein the inner portion has a width A that is smaller than a width B of the outer portion by a distance sufficient to engage the serrated edge with the crushed area, but not so great as to extend the serrated edge through the sheet of material.

20. A container having a plurality of walls surrounding a central portion and formed of a planar sheet of material, comprising;

two side walls, one each on opposing sides of the central portion and folded perpendicular to the central portion along a side fold line interposed between each side and the central portion;

four tabs, one each extending along a length of each side and from an opposing end of each side, the tabs adapted to fold perpendicular to the side along a tab fold line interposed between each tab and the adjacent side;

two crushed areas, one each located at opposing ends of the central portion and between the side walls, the crushed areas extending adjacent to, but not all the way to each side wall, a slit that does not extend completely through the material and which defines a lip extends along a substantial length of one side of each crushed area, the lip being located on a side of the crushed area located toward the central portion, and a perforation line extending through the material and parallel to the slit, the crushed area being crushed sufficiently to allow locking access to the lip but not forming an opening extending entirely through the sheet of material;

two end walls each formed by an end roll portion, one each on opposing ends of the central portion and located between two side walls, each end roll located distal of the crushed areas and comprising an inner portion and a distal portion, the distal portion having a distal edge that is serrated, the inner portion being folded along the perforated line located along a distal side of the crushed area located away from the central portion, the inner and distal portions being folded about at least one intervening fold line to place the serrated edge into the crushed area so the lip engages the serrated edge, the inner and intervening fold line being parallel but each being perpendicular to the side fold lines, the tabs being configured to be placed inside the adjacent, folded inner and distal portions.

21. The container of claim 20, wherein the material comprises C flute corrugated material.

22. The container of claim 20, wherein the tabs have an outer edge that is recessed from a line extending along a distal edge of the sides, the recess being about the thickness of the material.

23. The container of claim 22, wherein the serrated edge terminates at a location adjacent each end of the serrated edge to form a bumper portion.

24. The container of claim 23, wherein the tabs and end rolls are separated by a space sufficient to allow assembly by automated machinery.

25. The container of claim 24, wherein the side walls have a length measured parallel to the plane of the central portion that is shorter than a length of the end walls.

26. The container of claim 25, further comprising a release material placed on the central portion, and a food material placed on the release material.

27. The container of claim 26, wherein the food material comprises cake batter which is baked to form a cake within the container.

28. A container having a plurality of walls surrounding a central portion and formed of a planar sheet of material, wherein at least two walls are formed from end rolls containing serrated edge means cooperating with crushed means forming a lip to receive the serrated edge means, the end rolls receiving interlocking tabs on the ends of adjacent walls to lock the walls into a position perpendicular to the central portion.

29. A method of forming a walled container from a sheet of material having four tabs at the distal ends of two opposing sides that form side walls, and having end rolls intermediate the sides with the end rolls also forming two walls, the tabs contained within the end rolls to interlock the side walls with the walls formed by the end rolls, comprising the steps of:

providing a cut line bordering on a crushed area along a length of each wall formed by the end rolls, and adjacent that wall, the crushed area being formed with a reduced thickness sufficient to expose a lip along a length of the cut line, the cut line and crushed area being formed in the central portion adjacent the wall formed by the end rolls, neither the cut line nor the crushed area extending completely through the material;

providing a serrated edge on a distal edge of the of the end rolls and folding the end roll about fold lines parallel to the cut line to place the serrated edge of each end roll into the crushed area so as to engage the lip along a sufficient length of the exposed lip to interlock the serrated edge in the crushed area and interlock the tabs in the end rolls.

30. The method of claim 29, comprising the further step of limiting the distance the serrated edge can be inserted into the crushed area by placing a bumper portion positioned to engage an uncrushed portion on the central portion so as to limit the movement of the serrated edge.

31. A method of forming a container from a planar sheet of corrugated material, the container having walls surrounding a central portion, at least one of the walls being formed from an end roll having an inner portion and a distal portion separated by at least one fold line so the distal portion folds toward the inner portion to hold end tabs from adjacent walls between the inner portion and the distal portion, a distal edge of the distal portion being serrated, the central portion having an elongated crushed area bounded by a slit to form a lip around a substantial portion of the crushed area, the crushed area being located adjacent the inner portion with neither the slot nor the crushed area extending completely through the sheet, comprising the step of:

folding the end roll so the serrated edge enters engages the lip to lock the distal portion in the crushed area without extending the serrated edge completely through the sheet of material.

32. The method of claim 31, comprising the further step of limiting a distance that the serrated edge enters the material by placing corresponding abutting surfaces on the serrated edge and the die cut blank to limit movement of the serrated edge relative to the lip.

* * * * *